US005439788A

United States Patent [19]

Takehara

[11] Patent Number: 5,439,788

[45] Date of Patent: Aug. 8, 1995

[54] METHOD OF MANUFACTURING SILVER HALIDE EMULSION

[75] Inventor: Hiroshi Takehara, Ashigara, Japan

[73] Assignee: Fuji Photo Film Co., Ltd., Kanagawa, Japan

[21] Appl. No.: 233,946

[22] Filed: Apr. 28, 1994

[30] Foreign Application Priority Data

Apr. 30, 1993 [JP] Japan ..... 5-124612

[51] Int. Cl.[6] ..... G03C 1/025; G03C 1/015

[52] U.S. Cl. ..... 430/569; 430/583; 430/584; 430/585; 430/568

[58] Field of Search ..... 430/569, 583, 584, 585, 430/568

[56] References Cited

U.S. PATENT DOCUMENTS 4,225,666 9/1980 Locker et al. ..... 430/569
4,828,972 5/1989 Ihama et al. ..... 430/569
5,338,655 8/1994 Kubotera et al. ..... 430/569

FOREIGN PATENT DOCUMENTS

0533033A1 3/1993 European Pat. Off. .
61-133941 6/1986 Japan .
63-41849 2/1988 Japan .

*Primary Examiner*—Charles L. Bowers, Jr.
*Assistant Examiner*—Mark F. Huff
*Attorney, Agent, or Firm*—Birch, Stewart, Kolasch & Birch

[57] ABSTRACT

In a method of manufacturing a light-sensitive silver halide emulsion with an average grain size of 0.04 to 0.2 μm, a sensitizing dye is added at a temperature of 25° C. to 50° C., and subsequently chemical ripening is performed at a temperature higher than the addition temperature of the sensitizing dye.

17 Claims, No Drawings

METHOD OF MANUFACTURING SILVER HALIDE EMULSION

BACKGROUND OF THE INVENTION

1. Field of the Invention

The present invention relates to a method of manufacturing a fine-grain silver halide emulsion, which has the property of extremely high graininess and sharpness, yet which is at the same time very stable in the whole process of manufacturing of a silver halide light-sensitive material.

2. Description of the Related Art

Recently, photographic light-sensitive materials have been required to meet more diversified, higher-level demands.

Especially in color intermediate films for movies and the like, it is necessary to improve the graininess and the sharpness significantly.

To improve the graininess and the sharpness, it is known that a grain size need only be decreased although there is a certain limit. According to the studies made by the present inventor, however, decreasing an average grain size to 0.2 μm or less leads to a serious problem; i.e., the stability of emulsion is degraded with time if it is aged in the form of a solution.

Performing chemical sensitization in the presence of sensitizing dyes is disclosed in, e.g., JP-A-55-26589 ("JP-A" means Unexamined Published Japanese Patent Application), JP-A-61-103149, and JP-A-61-133941), and it is known that emulsions with a high sensitivity and a high storage stability can be obtained by this method. In JP-A-63-41849, it is attempted to, e.g., reduce a storage fog or prevent decreasing the contrast by adding sensitizing dyes during formation of silver halide grains. Also, in JP-A-5-80445, it is attempted to improve the stability in manufacturing process and increase the contrast by adding sensitizing dyes at relatively low temperatures and then performing chemical sensitization at high temperatures.

None of these patents, however, mentions the stability with time upon solution aging of grains with an average grain size of 0.2 μm or less.

SUMMARY OF THE INVENTION

It is an object of the present invention to provide a method of manufacturing a small-size emulsion with an average grain size of 0.2 μm or less, by which it is possible to obtain an emulsion having very high graininess and sharpness yet at the same time having a high stability in manufacturing process of a silver halide light-sensitive material, particularly, a high stability when the emulsions are aged in the form of a solution.

The above object is achieved by means (1) to (5) below.

(1) A method of manufacturing a light-sensitive silver halide emulsion with an average grain size of 0.04 to 0.2 μm, wherein a sensitizing dye is added at a temperature of 25° C. to 50° C., and subsequently chemical ripening is performed at a temperature higher than the addition temperature of the sensitizing dye.

(2) The method described in item (1) above, wherein an average silver iodide content of the silver halide emulsion is 1 to 6 mol %.

(3) The method described in item (1) or (2) above, wherein the average grain size of the silver halide emulsion is 0.13 μm or less.

(4) The method described in item (1) or (2) above, wherein an average silver chloride content of the silver halide emulsion is 3 mol % or less.

(5) The method described in item (1) or (2) above, wherein a variation coefficient of a grain size distribution of the silver halide emulsion is 0.15 or less.

DETAILED DESCRIPTION OF THE INVENTION

In the present invention, the average grain size (r) of a silver halide is 0.2 μm or less. This average grain size (r) is given by:

$$\bar{r} = \frac{\Sigma r_i}{n}$$

where $r_i$ is, in the case of a cubic grain, the length of an edge of the grain, and, in the case of a grain other than a cubic grain, the length of an edge of a cube having the same volume as that of the grain, and n is the total number of measured grains. The average grain size is obtained by measuring $r_i$ of at least three hundred grains.

In the prevent invention, the average grain size (r) is 0.2 to 0.04 μm. If the grain size is smaller than 0.04 μm, it is sometimes impossible to achieve a satisfactory stability in manufacturing process even by the present invention. Preferably, the average grain size is 0.13 μm to 0.04 μm. When the average grain size of the silver halide emulsion is 0.13 μm to 0.04 μm, an extremely good graininess is achieved.

In the present invention, the variation coefficient of a grain size distribution (σ) represented by the following equation is preferably 0.15 or less.

$$S \text{ (standard deviation)} = \sqrt{\frac{\Sigma(r - r_i)^2 n_i}{\Sigma n_i}}$$

$$\sigma \text{ (variation coefficient)} = \frac{S}{\bar{r}}$$

In the present invention, sensitizing dyes are added at a temperature of 25° C. to 50° C. If the temperature at adding a sensitizing dye is set to the range of 25° C. to 50° C., the degrading of the stability of the silver halide emulsion with an average grain size of 0.2 μm or less, when the emulsion is aged in the form of solution, is prevented. Preferably, the temperature at adding a sensitizing dye is set to 35° C. to 45° C. If the temperature at adding a sensitizing dye is 35° C. to 45° C., an extremely high stability of emulsion, when the emulsion is aged in the form of solutions, is achieved. After the sensitizing dye is added to the emulsion, the emulsion is maintained at the same temperature as the temperature at the adding for 5 minutes or more.

The addition amount of the sensitizing dye is preferably $1\times10^{-5}$ mol to $1\times10^{-2}$ mol, and more preferably $5\times10^{-5}$ mol to $5\times10^{-4}$ mol per mol of silver halide.

In the present invention, the whole or a portion of the total amount of the sensitizing dye is added at 25° C. to 50° C. When a portion of the sensitizing dye is added at the temperature of 25° C. to 50° C., the remaining portion of the sensitizing dye is preferably added after the chemical ripening. The temperature at adding the remaining portion of the dye after the chemical ripening is preferably the same temperature as, or lower temperature than, the temperature at the chemical ripening.

The sensitizing dyes used in the present invention are not particularly limited. For example, it is possible to use a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. Any nucleus commonly used as a basic heterocyclic nucleus in cyanine dyes can be applied to these dyes. Examples of an applicable nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxazole nucleus, a naphthoxazole nucleus, a benzthiazole nucleus, a naphthothiazole nucleus, a benzoselenazole nucleus, a benzimidazole nucleus, and a quinoline nucleus. These nuclei may have a substitution group on the carbon atom.

It is possible to apply to a merocyanine dye or a composite merocyanine dye a 5- to 6-membered heterocyclic nucleus as a nucleus having a ketomethylene structure. Examples are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

Although these sensitizing dyes may be used singly, they can also be used together. The combination of sensitizing dyes is often used for a supersensitization purpose. Representative examples of the combination are. described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B-43-4936 ("JP-B" means Examined Published Japanese Patent Application), JP-B-53-12375, JP-A-52-110618, and JP-A-52-109925.

Emulsions may contain, in addition to the sensitizing dyes, dyes having no spectral sensitizing effect or substances not essentially absorbing visible light and presenting supersensitization.

various conventionally proposed methods can be applied as a method of adding the sensitizing dyes to photographic emulsions. For example, as described in U.S. Pat. No. 4,469,987, it is possible to dissolve sensitizing dyes in a volatile organic solvent, disperse the resultant solution in a hydrophilic colloid, and add the resultant dispersion to an emulsion. In addition, the sensitizing dyes used in the present invention can be dissolved in the same solvent or in different solvents. In this case, the obtained solutions can be mixed and added in the form of a mixture to an emulsion or added to an emulsion independently of one another.

In the present invention, as a dye solvent used to add the sensitizing dyes to a silver halide emulsion, a water-miscible organic solvent such as methyl alcohol, ethyl alcohol, or acetone can be preferably used.

As a method of adding an substantially water-soluble dye to an emulsion, it is possible to use a method by which the dye is dispersed in water with the aid of a dispersant (surfactant) and directly added in the form of a dispersion or added in the form of a powder obtained by drying the resultant dispersion; a method by which the dye is mixed in a dispersant by using gelatin as a binder and directly added in the form of a homogeneous mixture (a gel, a paste, or a slurry) or added in the form of a granular product obtained by drying the mixture; and a method by which the dye is milled into fine grains with a diameter of 1 $\mu$m or less in water without using any dispersant (a binder such as gelatin can be used) and added in the form of a dispersion.

In the present invention, chemical ripening is performed subsequently to the addition of the sensitizing dyes at temperatures higher than the addition temperature of the sensitizing dye. Preferably, after the temperature is kept at the same temperature as the temperature at adding the sensitizing dye for at least five minutes, the temperature is raised and the chemical ripening is started. The chemical ripening means aging performed at 50° C. or higher under stirring in the presence of a chemical sensitizer, e.g., a chalcogen sensitizer which is normally used, such as a sulfur sensitizer or a selenium sensitizer, or a noble metal sensitizer, such as a gold sensitizer. Although the chemical sensitizer can be added either before or after the addition of the sensitizing dyes, the chemical ripening must be performed after the addition of the sensitizing dyes at temperatures higher than the addition temperature. The chemical ripening temperature must be higher by 1° C. or more than the addition temperature of the sensitizing dyes. The chemical ripening temperature is preferably higher by 10° C. or more.

Sulfur sensitizers known to those skilled in the art can be used in sulfur sensitization. Examples of the sulfur sensitizer are thiosulfate, thioureas, allylisothiacyanate, cystine, p-toluenethiosulfonate, and rhodanine. It is also possible to use sulfur sensitizers described in, e.g., U.S. Pat. Nos. 1,574,944, 2,410,689, 2,278,947, 2,728,668, 3,501,313, and 3,656,955, German Patent 1,422,869, JP-B-56-24937, and JP-A-55-45016. The addition amount of the sulfur sensitizer need only be the one that can effectively increase the sensitivity of an emulsion. Although this amount changes over a considerable range in accordance with various conditions, such as a pH, a temperature, and the size of silver halide grains, it is preferably $1\times10^{-7}$ mol to $5\times10^{-4}$ mol per mol of silver halide.

The gold sensitizer can be any compound having an oxidation number of gold of +1 or +3, and it is possible to use gold compounds normally used as a gold sensitizer. Representative examples of the gold sensitizer are chloroaurate, potassium chloroaurate, auricrichloride, potassium auricthiocyanate, potassium iodoaurate, tetracyanoauric acid, ammonium aurothiacyanate, and pyridyltrichlorogold.

Although the addition amount of the gold sensitizer changes in accordance with various conditions, it is preferably $1\times10^{-7}$ mol and $5\times10^{-4}$ mol per mol of silver halide.

In the chemical ripening, it is not particularly necessary to limit the addition timings and the addition order of the silver halide solvent and the selenium sensitizer or the sulfur sensitizer and/or the gold sensitizer and the like that can be used together with the selenium sensitizer. For example, the above compounds can be added simultaneously or at different addition timings in (preferably) the initial stage of or during the chemical ripening. The above compounds are dissolved in water, an organic solvent mixable with water, such as methanol, ethanol, or acetone, or a solvent mixture of these organic solvents, and the resultant solution is added to an emulsion.

The selenium compounds disclosed in patents conventionally known to those skilled in the art can be used as a selenium sensitizer for use in the present invention. It is common practice to perform sensitization by adding a labile selenium compound and/or a non-labile selenium compound to an emulsion and stirring the emulsion at high temperatures, preferably 50° C. or more for a predetermined time. Preferable examples of the labile selenium compound are described in JP-B-44-15748, JP-B-43-13489, JP-A-4-025832 and JP-A-4-109240. Practical examples of the labile selenium sensitizer are isoselenocyanates (e.g., aliphatic isoselenocyanates such as allylisoselenocyanate), selenoureas, selenoketones, selenoamides, selenocarboxylic acids (e.g., 2-selenopropionic acid and 2-selenobutyric acid), selenoesters, diacylselenides (e.g., bis(3-chloro-2,6-dimethoxybenzoyl)selenide), selenophosphates, phosphineselenides, and colloidal metal selenium.

Although preferable examples of the labile selenium compound are described above, the present invention is not limited to these examples. It is generally agreed by those skilled in the art that the structure of a labile selenium compound used as a sensitizer for a photographic emulsion is not so important as long as selenium is labile, and that the organic part of a molecule of the selenium sensitizer has no important role except the role of carrying selenium and keeping it in a labile state in an emulsion. In the present invention, therefore, labile selenium compounds in this extensive concept are advantageously used.

Examples of the non-labile selenium compound used in the present invention are those described in JP-B-46-4553, JP-B-52-34492, and JP-B-52-34491. Specific examples of the non-labile selenium compound are selenious acid, potassium selenocyanide, selenazoles, quaternary salts of selenazoles, diarylselenide, diaryldiselenide, dialkylselenide, dialkyldiselenide, 2-selenazolidinedione, 2-selenoxazolidinethione, and derivatives of these compounds.

Among these selenium compounds, those preferably used in the present invention are compounds represented by Formulas (I) and (II) below.

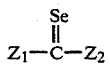

Formula (I)

wherein $Z_1$ and $Z_2$ may be the same or different and each represents an alkyl group (e.g., methyl, ethyl, t-butyl, adamantyl, and t-octyl); an alkenyl group (e.g., vinyl and propenyl); an aralkyl group (e.g., benzyl and phenethyl); an aryl group (e.g., phenyl, pentafluorophenyl, 4-chlorophenyl, 3-nitrophenyl, 4-octylsulfamoylphenyl, and α-naphthyl); a heterocyclic group (e.g., pyridyl, thienyl, furyl, and imidazolyl); $—NR_1(R_2)$; or $—OR_3$ or $—SR_4$.

$R_1$, $R_2$, $R_3$, and $R_4$ may be the same of different and each represents an alkyl group, an aralkyl group, an aryl group, or a heterocyclic group. Examples of the alkyl group, the aralkyl group, the aryl group, and the heterocyclic group can be the same as those enumerated above for $Z_1$.

Note that each of $R_1$ and $R_2$ can be a hydrogen atom or an acyl group (e.g., acetyl, propanoyl, benzoyl, heptafluorobutanoyl, difluoroacetyl, 4-nitrobenzoyl, α-naphthoyl, and 4-trifluoromethylbenzoyl).

In Formula (I), $Z_1$ preferably represents an alkyl group, an aryl group, or $—NR_1(R_2)$ and $Z_2$ preferably represents $—NR_5(R_6)$ wherein $R_1$, $R_2$, $R_5$, and $R_6$ may be the same or different and each represents a hydrogen atom, an alkyl group, an aryl group, or an acyl group.

More preferable examples of a selenium compound represented by Formula (I) are N,N-dialkylselenourea, N,N,N'-trialkyl-N'-acylselenourea, tetraalkylselenourea, N,N-dialkyl-arylselenoamide, and N-alkyl-N-aryl-arylselenoamide.

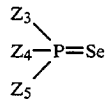

Formula (II)

wherein $Z_3$, Z4, and $Z_5$ may be the same or different and each represents an aliphatic group, an aromatic group, a heterocyclic group, $—OR_7$, $—NR_8(R_9)$, $—SR_{10}$, $—SeR_{11}$, X, or a hydrogen atom.

Each of $R_7$, $R_{10}$, and $R_{11}$ represents an aliphatic group, an aromatic group, a heterocyclic group, a hydrogen atom, or a cation, and each of $R_8$ and $R_9$ represents an aliphatic group, an aromatic group, a heterocyclic group, or a hydrogen atom. X represents a halogen atom.

In Formula (II), an aliphatic group represented by $Z_3$, $Z_4$, $Z_5$, $R_7$, $R_8$, $R_9$, $R_{10}$, or $R_{11}$ represents a straight-chain, branched, or cyclic alkyl, alkenyl, alkinyl, or aralkyl group (e.g., methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl, and phenethyl).

In Formula (II), an aromatic group represented by $Z_3$, $Z_4$, $Z_5$, $R_7$, $R_8$, $R_9$, $R_{10}$, or $R_{11}$ represents a monocyclic or condensed-ring aryl group (e.g., phenyl, pentafluorophenyl, 4-chlorophenyl, 3-sulfophenyl, α-naphthyl, and 4-methylphenyl).

In Formula (II), a heterocyclic group represented by $Z_3$, $Z_4$, $Z_5$, $R_7$, $R_8$, $R_9$, $R_{10}$, or $R_{11}$ represents a 3to 10-membered saturated or unsaturated heterocyclic 10 group (e.g., pyridyl, thienyl, furyl, thiazolyl, imidazolyl, and benzimidazolyl) containing at least one of a nitrogen atom, an oxygen atom, and a sulfur atom.

In Formula (II), a cation represented by $R_7$, $R_{10}$, or $R_{11}$ represents an alkali metal atom or ammonium, and a halogen atom represented by X represents a fluorine atom, a chlorine atom, a bromine atom, or an iodine atom.

In Formula (II), $Z_3$, $Z_4$, or $Z_5$ preferably represents an aliphatic group, an aromatic group, or $—OR_7$, and $R_7$preferably represents an aliphatic group or an aromatic group.

More preferable examples of a compound represented by Formula (II) are trialkylphosphineselenide, triarylphosphineselenide, trialkylselenophosphate, and triarylselenophosphate.

Practical examples of compounds represented by Formulas (I) and (II) are shown below, but the present invention is not limited to these examples.

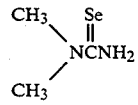

Se-1

-continued
Se-2
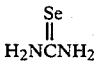
Se-3
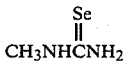
Se-4
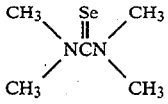
Se-5
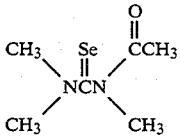
Se-6
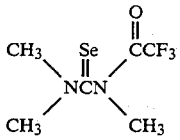
Se-7
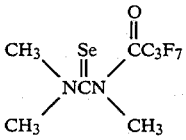
Se-8
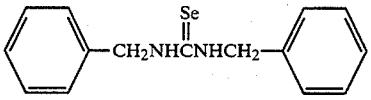
Se-9
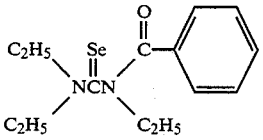
Se-10
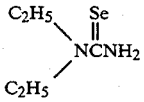
Se-11
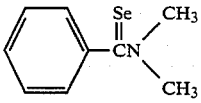
Se-12
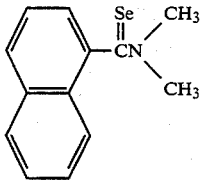
Se-13
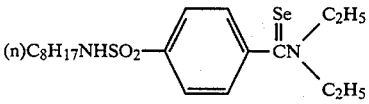
Se-14
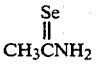
-continued
Se-15
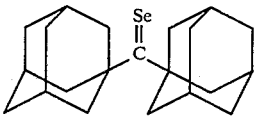
Se-16
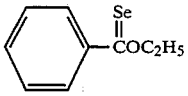
Se-17
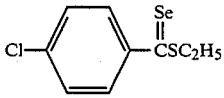
Se-18
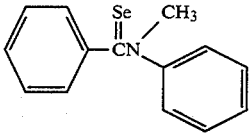
Se-19
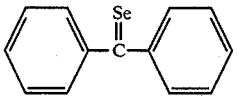
Se-20
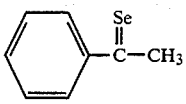
Se-21
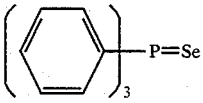
Se-22
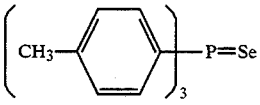
Se-23
$(nC_4H_9)_3P{=}Se$
Se-24
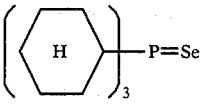
Se-25
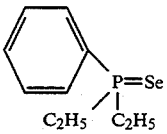
Se-26
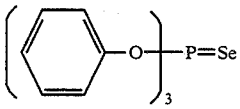
Se-27
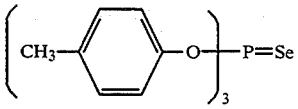

-continued

Se-28 $(nC_4H_9O)_3P{=}Se$

Se-29

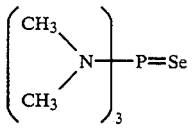

Se-30 $(C_2H_5O)_3P{=}Se$

Se-31

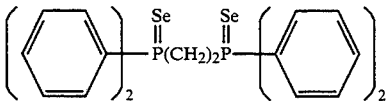

Se-32 $(nC_8H_{17})_3P{=}Se$

Se-33

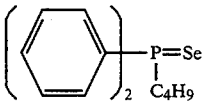

Se-34

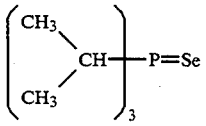

Se-35

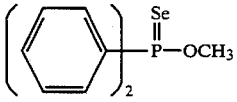

Se-36

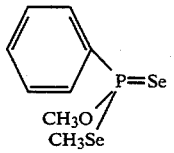

Se-37

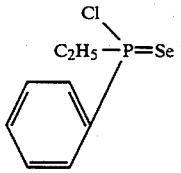

Se-38

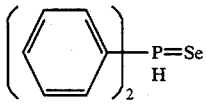

Se-39 $(CH_3)_2P{=}Se$ $CH_3S$

-continued

Se-40

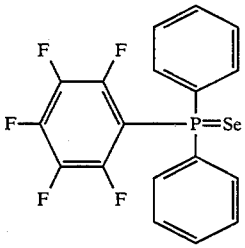

These selenium sensitizers are dissolved in any of water, an organic solvent, such as methanol or ethanol, and a solvent mixture of these organic solvents, and the resultant solution is added during chemical sensitization. Alternatively, the selenium sensitizers are added in the form described in JP-A-4-140738 or JP-A-4-140739 chemical sensitization. The addition is preferably performed before the start of chemical sensitization. A selenium sensitizer used is not limited to one type, but two or more types of the selenium sensitizers described above can be used together. It is also possible to use both the labile and the non-labile selenium sensitizers.

The addition amount of the selenium sensitizers used in the present invention changes in accordance with the activity of each selenium sensitizer used, the type or grain size of a silver halide, and the temperature and time of ripening. The addition amount, however, is preferably $1\times10^{-8}$ mol or more, and more preferably $1\times10^{-7}$ mol to $1\times10^{-4}$ mol per mol of silver halide. When the selenium sensitizers are used, the temperature of chemical ripening is preferably 50° C. or more, and more preferably 50° C. to 80° C. The pAg and the pH can take any given values. As an example, the effect of the present invention can be obtained over a broad pH range of 4 to 9.

The chemical ripening can also be performed in the presence of a silver halide solvent.

Examples of the silver halide solvent usable in the present invention are (a) organic thioethers described in, e.g., U.S. Pat. Nos. 3,271,157, 3,531,289, and 3,574,628, JP-A-54-1019, and JP-A-54-158917, (b) thiourea derivatives described in JP-A-53-82408, JP-A-55-77737, and JP-A-55-2982, (c) a silver halide solvent having a thiocarbonyl group sandwiched between an oxygen or sulfur atom and a nitrogen atom described in JP-A-53-144319, (d) imidazoles described in JP-A-54-100717, (e) sulfite, and (f) thiocyanate.

Most preferable examples of the solvent are thiocyanate and tetramethylthiourea. Although the amount of the solvent to be used changes in accordance with its type, a preferable amount of, e.g., thiocyanate is $1\times10^{-4}$ to $1\times10^{-2}$ mol per mol of a silver halide.

It is, however, sometimes preferable to use no silver halide solvent for particularly grains with an average grain size of 0.10 μm or less in respect of the manufacturing stability.

The average silver iodide content of the silver halide emulsion for use in the present invention is preferably 1 to 6 mol %. The emulsion may contain silver chloride in an amount by which the effect of the present invention is not degraded. In this case, the value of the average silver chloride content is preferably 3 mol % or less.

The silver halide grain for use in the present invention consists of silver bromide, silver chloride, silver iodide, silver chlorobromide, silver iodochloride, silver iodobromide, or silver bromochloroiodide. The silver halide grain may contain another silver salt, such as silver rhodanate, silver sulfide, silver selenide, silver carbonate, silver phosphate, or silver salt of an organic acid, as another grain or as part of the grain. When rapid development and desilvering (bleaching, fixing, and bleach-fixing) processes are demanded, silver halide grains with a large silver chloride content are desirable. To suppress development appropriately, the grains preferably contain silver iodide.

The silver halide emulsion of the present invention preferably has a distribution or a structure associated with a halogen composition in its grains. A typical example of such a grain is a core-shell or double-structure grain having different halogen compositions in its interior and surface layer as disclosed in, e.g., JP-B-43-13162, JP-A-61-215540, JP-A-60-222845, JP-A-60-143331, or JP-A-61-75337. The structure need not be a simple double structure but may be a triple structure or a multiple structure larger than the triple structure as disclosed in JP-A-60-222844. It is also possible to bond a thin silver halide having a different composition on the surface of a core-shell double-structure grain.

The structure to be formed inside a grain need not be the surrounding structure as described above but may be a so-called junctioned structure. Examples of the junctioned structure are disclosed in JP-A-59-133540, JP-A-58-108526, EP 199,290A2, JP-B-58-24772, and JP-A-59-16254. A crystal to be junctioned can be formed on the edge, the corner, or the face of a host crystal to have a different composition from that of the host crystal. Such a junctioned crystal can be formed regardless of whether a host crystal is uniform in halogen composition or has a core-shell structure.

In the case of the junctioned structure, it is naturally possible to use a combination of silver halides. However, it is also possible to form the junctioned structure by combining a silver halide and a silver salt compound not having a rock salt structure, such as silver rhodanate or silver carbonate. In addition, a non-silver salt compound, such as lead oxide, can also be used provided that formation of the junctioned structure is possible.

In a silver iodobromide grain or the like having any of the above structures, it is preferable that the silver iodide content in a core portion be higher than that in a shell portion. In contrast, it is sometimes preferable that the silver iodide content in the core portion be low and that in the shell portion be high. Similarly, in a junctioned-structure grain, the silver iodide content may be high in a host crystal and low in a junctioned crystal and vice versa. The boundary portion between different halogen compositions in a grain having any of the above structures may be either definite or indefinite. It is also possible to positively form a continuous composition change.

In a silver halide grain in which two or more silver halides are present as a mixed crystal or with a structure, it is important to control the distribution of halogen compositions between grains. A method of measuring the distribution of halogen compositions between grains is described in JP-A-60-254032. A uniform halogen distribution between grains is a desirable characteristic. In particular, a highly uniform emulsion having a variation coefficient of 20% or less is preferable. An emulsion having a correlation between a grain size and a halogen composition is also preferable. An example of the correlation is that larger grains have higher iodide contents and smaller grains have lower iodide contents. An opposite correlation or a correlation with respect to another halogen composition can also be selected in accordance with the intended use. For this purpose, it is preferable to mix two or more emulsions having different compositions.

It is important to control the halogen composition near the surface of a grain. Increasing the silver iodide content or the silver chloride content near the surface changes a dye adsorbing property or a developing rate, and so this makes it possible to select a halogen composition in accordance with the intended use. In order to change the halogen composition near the surface, it is possible to select either the structure in which a grain is entirely surrounded by a silver halide or the structure in which a silver halide is adhered to only a portion of a grain. For example, a halogen composition of only one of a (100) face and a (111) face of a tetradecahedral grain may be changed, or a halogen composition of one of a major face or a side face of a tabular grain may be changed.

Silver halide grains for use in the present invention can be selected in accordance with the intended use. Examples are a regular crystal not containing a twin plane and crystals explained in Japan Photographic Society ed., The Basis of Photographic Engineering, Silver Salt Photography (CORONA PUBLISHING CO., LTD.), page 163, such as a single twinned crystal containing one twin plane, a parallel multiple twinned crystal containing two or more parallel twin planes, and a nonparallel multiple twinned crystal containing two or more nonparallel twin planes. A method of mixing grains having different shapes is disclosed in U.S. Pat. No. 4,865,964, so this method can be selected as needed. In the case of a regular crystal, it is possible to use a cubic grain constituted by (100) faces, an octahedral grain constituted by (111) faces, or a dodecahedral grain constituted by (110) faces disclosed in JP-B-55-42737 or JP-A-60-222842. It is also possible to use, in accordance with the intended use of an emulsion, an (h11) face grain represented by a (211) face grain, an (hh1) face grain represented by a (331) face grain, an (hk0) face grain represented by a (210) face grain, or an (hk1) face grain represented by a (321) face grain, as reported in Journal of Imaging Science, vol. 30, page 247, 1986, although the preparation method requires some improvements. A grain having two or more different faces, such as a tetradecahedral grain having both (100) and (111) faces, a grain having (100) and (110) faces, or a grain having (111) and (110) faces can also be used in accordance with the intended use of an emulsion.

A value obtained by dividing the equivalent-circle diameter of the projected area of a grain by the thickness of that grain is called an aspect ratio that defines the shape of a tabular grain. Tabular grains having aspect ratios higher than 1 can be used in the present invention. Tabular grains can be prepared by the methods described in, e.g., Cleve, Photography Theory and Practice (1930), page 131; Gutoff, Photographic Science and Engineering, Vol. 14, pages 248 to 257, (1970); and U.S. Pat. Nos. 4,434,226, 4,414,310, 4,433,048, and 4,439,520, and British Patent 2,112,157. The use of tabular grains brings about advantages, such as an increase in covering power and an increase in spectral sensitization efficiency of sensitizing dyes. These advantages are described in detail in U.S. Pat. No. 4,434,226 cited above. An average aspect ratio of 80% or more of a total projected area of grains is preferably 1 to less than 100, more preferably 2 to less than 20, and most preferably 3 to less than 10. The shape of a tabular grain can be selected from, e.g., a triangle, a hexagon, and a circle. An example of a preferable shape is a regular hexagon having six substantially equal sides, as described in U.S. Pat. No. 4,797,354.

In the case of a tabular grain, dislocation lines can be observed by using a transmission electron microscope. It is preferable to select a grain containing no dislocations, a grain containing several dislocations, or a grain containing a large number of dislocations in accordance with the intended use. It is also possible to select dislocations introduced linearly with respect to a specific direction of a crystal orientation of a grain or dislocations curved. Alternatively, it is possible to selectively introduce dislocations throughout an entire grain or only to a particular portion of a grain (e.g., the fringe portion of a grain). Such introduction of dislocation lines is preferable not only for tabular grains but for a regular crystal grain or an irregular grain represented by a potato-like grain. In these cases, as in the above case, it is favorable to limit the positions of dislocation lines to specific portions such as the corners or the edges of a grain.

A silver halide emulsion used in the present invention may be subjected to a treatment for rounding grains, as disclosed in EP 96,727B1 or EP 64,412B1, or surface modification, as disclosed in West German Patent 2,306,447C2 or JP-A-60-221320.

Although a flat grain surface is common, intentionally forming projections and recesses on the surface is preferable in some cases. Examples are the methods described in JP-A-58-106532 and JP-A-60-221320, in which a hole is formed in a portion of a crystal (e.g., the corner or the center of the face of a crystal), and the ruffle grain described in U.S. Pat. No. 4,643,966.

Photographic emulsions used in the present invention can be prepared by the methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, a neutral method, and an ammonia method can be used. In forming grains by a reaction of a soluble silver salt and a soluble halogen salt, any of a single-Jet method, a double-jet method, and a combination of these methods can be used. It is also possible to use a method (so-called reverse double-jet method) of forming grains in the presence of excess silver ion. As one type of the double-jet method, a method in which the pAg of a liquid phase for producing a silver halide is maintained constant, i.e., a so-called controlled double-jet method can be used. This method makes it possible to obtain a silver halide emulsion in which a crystal shape is regular and a grain size is nearly uniform.

In some cases, it is preferable to make use of a method of adding silver halide grains already formed by precipitation to a reactor vessel for emulsion preparation, and the methods described in U.S. Pat. Nos. 4,334,012, 4,301,241, and 4,150,994. These silver halide grains can be used as seed crystal and are also effective when supplied as a silver halide for growth. In the latter case, addition of an emulsion with a small grain size is preferable. The total amount of an emulsion can be added at one time, or an emulsion can be separately added a plurality of times or added continuously. In addition, it is sometimes effective to add grains having several different halogen compositions in order to modify the surface.

A method of converting most of or only a part of the halogen composition of a silver halide grain by a halogen conversion process is disclosed in, e.g., U.S. Pat. Nos. 3,477,852 and 4,142,900, EP 273,429 and EP 273,430, and West German Patent 3,819,241. This method is an effective grain formation method. To convert into a silver salt that is more hard to soluble, it is possible to add a solution or silver halide grains of a soluble halogen. The conversion can be performed at one time, separately a plurality of times, or continuously.

As a grain growth method other than the method of adding a soluble silver salt and a halogen salt at a constant concentration and a constant flow rate, it is preferable to use a grain formation method in which the concentration or the flow rate is changed, such as described in British Patent 1,469,480 and U.S. Pat. Nos. 3,650,757 and 4,242,445. Increasing the concentration or the flow rate can change the amount of a silver halide to be supplied as a linear function, a quadratic function, or a more complex function of the addition time. It is also preferable to decrease the silver halide amount to be supplied if necessary. Furthermore, when a plurality of soluble silver salts of different solution compositions are to be added or a plurality of soluble halogen salts of different solution compositions are to be added, a method of increasing one of the salts while decreasing the other is also effective.

A mixing vessel for reacting solutions of soluble silver salts and soluble halogen salts can be selected from those described in U.S. Pat. Nos. 2,996,287, 3,342,605, 3,415,650, and 3,785,777 and West German Patents 2,556,885 and 2,555,364.

A silver halide solvent is useful for the purpose of accelerating ripening. As an example, it is known to make an excess of halogen ion exist in a reactor vessel in order to accelerate ripening. Another ripening agent can also be used. The total amount of these ripening agents can be mixed in a dispersing medium placed in a reactor vessel before addition of silver and a halide salt or can be introduced to the reactor vessel simultaneously with addition of a halide salt, a silver salt, and a deflocculant. Alternatively, ripening agents can be alone added in the step of adding a halide salt and a silver salt.

Examples of the ripening agent are ammonia, thiocyanate (e.g., potassium rhodanate and ammonium rhodanate), an organic thioether compound (e.g., compounds described in U.S. Pat. Nos. 3,574,628, 3,021,215, 3,057,724, 3,038,805, 4,276,374, 4,297,439, 3,704,130, and 4,782,013 and JP-A-57-104926), a thione compound (e.g., 4-substituted thioureas described in JP-A-53-82408, JP-A-55-77737, and U.S. Pat. No. 4,221,863, and compounds described in JP-A-53-144319), mercapto compounds capable of accelerating growth of Silver halide grains, described in JP-A-57-202531, and an amine compound (e.g., JP-A-54-100717).

It is advantageous to use gelatin as a protective colloid for use in preparation of emulsions of the present invention or as a binder for other hydrophilic colloid layers. However, another hydrophilic colloid can also be used in place of gelatin.

Examples of the hydrophilic colloid are protein, such as a gelatin derivative, a graft polymer of gelatin and another high polymer, albumin, and casein; a sugar derivative, such as hydroxyethylcellulose, carboxymethylcellulose, a cellulose derivative such as cellulose sulfates, soda alginate, and a starch derivative; and a variety of synthetic hydrophilic high polymers, such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

It is preferable to wash an emulsion of the present invention for a desalting purpose to form a newly prepared protective colloid dispersion. Although the temperature of washing can be selected in accordance with the intended use, it is preferably 5° C. to 50° C. Although the pH of washing can also be selected in accordance with the intended use, it is preferably 2 to 10, and more preferably 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of an emulsion of the present invention, it is preferable to make salt of metal ion exist during grain formation, desalting, or chemical sensitization, or before coating in accordance with the intended use. The metal ion salt is preferably added during grain formation in performing doping for grains, and after grain formation and before completion of chemical sensitization in decorating the grain surface or when used as a chemical sensitizer. The doping can be performed for any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide salt, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in a combination of two or more types of them.

The metal compounds are preferably dissolved in an appropriate solvent, such as methanol or acetone, and added in the form of a solution. To stabilize the solution, an aqueous hydrogen halide solution (e.g., HCl and HBr) or an alkali halide (e.g., KCl, NaCl, KBr, and NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, and KI) and added in the form of a solution continuously during formation of silver halide grains. Furthermore, a solution of the metal compounds can be prepared independently of a water-soluble silver salt or alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be made exist.

Silver halide emulsions of the present invention are preferably subjected to reduction sensitization during grain formation, after grain formation and before or during chemical sensitization, or after chemical sensitization.

The reduction sensitization can be selected from a method of adding reduction sensitizers to a silver halide emulsion, a method called silver ripening in which grains are grown or ripened in a low-pAg environment at pAg 1 to 7, and a method called high-pH ripening in which grains are grown or ripened in a high-pH environment at pH 8 to 11. It is also possible to perform two or more of these methods together.

The method of adding reduction sensitizers is preferred because the level of reduction sensitization can be finely adjusted.

Known examples of the reduction sensitizer are stannous chloride, ascorbic acid and its derivative, amines and polyamines, a hydrazine derivative, formamidinesulfinic acid, a silane compound, and a borane compound. In the reduction sensitization of the present invention, it is possible to selectively use these known reduction sensitizers or to use two or more types of compounds together. Preferable compounds as the reduction sensitizer are stannous chloride, thiourea dioxide, dimethylamineborane, and ascorbic acid and its derivative. Although an addition amount of the reduction sensitizers must be so selected as to meet the emulsion manufacturing conditions, a preferable amount is $10^{-7}$ mol to $10^{-3}$ mol per mol of silver halide.

The reduction sensitizers are dissolved in water or a solvent, such as alcohols, glycols, ketones, esters, or amides, and the resultant solution is added during grain growth. Although adding to a reactor vessel in advance is also preferable, adding at a given timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers may be added separately several times or continuously over a long time period with grain growth.

It is preferable to use an oxidizer for silver during the process of manufacturing emulsions of the present invention. The oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced may form a silver salt hard to dissolve in water, such as a silver halide, silver sulfide, or silver selenide, or a silver salt easy to dissolve in water, such as silver nitrate. The oxidizer for silver may be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2].6H_2O$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are an inorganic oxidizer such as ozone, hydrogen peroxide and its adduct, a halogen element, and thiosulfonate, and an organic oxidizer such as quinones.

A combination of the reduction sensitization described above and the oxidizer for silver is preferable. In this case, the reduction sensitization may be performed after the oxidizer is used or vice versa, or the reduction sensitization and the use of the oxidizer may be performed at the same time. These methods can be selectively performed during grain formation or chemical sensitization.

Photographic emulsions used in the present invention may contain various compounds in order to prevent fog during the manufacturing process, storage, or photographic treatments of a light-sensitive material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly 4-hydroxy-substituted(1,3-,3a,7)tetrazaindenes), and pentazaindenes. For example, compounds described in U.S. Pat. Nos. 3,954,474 and 3,982,947 and JP-B-52-28660 can be used. One preferable compound is described in Japanese Patent Application No. 62-47225. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion for various purposes of, e.g., controlling crystal habit of grains, decreasing a grain size, decreasing the solubility of grains, controlling chemical sensitization, and controlling an arrangement of dyes as well as their original for preventing effect and stabilizing effect.

When the invention is applied to color light-sensitive material, the light-sensitive material of the present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one unit light-sensitive layer constituted by a plurality of silver halide emulsion layers which are sensitive to essentially the same color but have different sensitivities or speeds. The unit light-sensitive layer is sensitive to blue, green or red light. In a multi-layered silver halide color photographic light-sensitive material, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in west German Patent 1,121,470 or British Patent 923,045. In this case, layers are preferably arranged such that the sensitivity or speed is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted. Furthermore, the arrangement can be changed as described above even when four or more layers are formed.

In the light-sensitive material of the present invention, two or more types of emulsions different in at least one of features such as a grain size, a grain size distribution, a halogen composition, a grain shape, and sensitivity can be mixed and used in the same layer.

Surface-fogged silver halide grains described in U.S. Pat. No. 4,082,553, internally fogged silver halide grains described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed despite the presence of a non-exposed portion and exposed portion of the light-sensitive material. A method of preparing the internally fogged or surface-fogged silver halide grain is described in U.S. Pat. No. 4,626,498 or JP-A-59-214852.

The silver halides which form the core of the internally fogged or surface-fogged core/shell silver halide grains may be of the same halogen composition or different halogen compositions. Examples of the internally fogged or surface-fogged silver halide are silver chloride, silver bromochloride, silver bromoiodide, and silver bromochloroiodide. Although the grain size of these fogged silver halide grains is not particularly limited, an average grain size is preferably 0.01 to 0.75 μm, and most preferably, 0.05 to 0.6 μm. The grain shape is also not particularly limited, and may be a regular grain shape. Although the emulsion may be a polydisperse emulsion, it is preferably a monodisperse emulsion (in which at least 95% in weight or number of silver halide grains have a grain size falling within a range of 40% of the average grain size).

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 molt of silver bromide and may contain silver chloride and/or silver iodide as needed. Preferably, the fine grain silver halide contains 0.5 to 10 mol % of silver iodide.

An average grain size (an average value of equivalent-circle diameters of projected areas) of the fine grain silver halide is preferably 0.01 to 0.5 μm, and more preferably, 0.02 to 0.2 μm.

The fine grain silver halide can be prepared by a method similar to a method of preparing normal light-sensitive silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain-containing layer preferably contains colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table:

| Additives | RD17643 December, 1978 | RD18716 November, 1979 | RD307105 November, 1989 |
|---|---|---|---|
| 1. Chemical sensitizers | page 23 | page 648, right column | page 866 |
| 2. Sensitivity-increasing agents | | page 648, right column | |
| 3. Spectral sensitizers, super-sensitizers | pp. 23–24 | page 648, right column to page 649, right column | pp. 866–868 |
| 4. Brighteners | page 24 | page 648, right column | page 868 |
| 5. Antifoggants, stabilizers | pp. 24–25 | page 649, right column | pp. 868–870 |
| 6. Light absorbent, filter dye, ultraviolet absorbents | pp. 25–26 | page 649, right column to page 650, left column | page 873 |
| 7. Stain-preventing agents | page 25, right column | page 650, left-right columns | page 872 |
| 8. Dye image-stabilizer | page 25 | page 650, left column | page 872 |
| 9. Hardening agents | page 26 | page 651, left column | pp. 874–875 |
| 10. Binder | page 26 | page 651, left column | pp. 873–874 |
| 11. Plasticizers, lubricants | page 27 | page 650, right column | page 876 |
| 12. Coating aids, surface active agents | pp. 26–27 | page 650, right column | pp. 875–876 |
| 13. Antistatic agents | page 27 | page 650, right column | pp. 876–877 |
| 14. Matting agent | | | pp. 878–879 |

In order to prevent degradation in photographic properties caused by formaldehyde gas, a compound described in U.S. Pat. Nos. 4,411,987 or 4,435,503, which can react with formaldehyde and fix the same, is preferably added to the light-sensitive material.

The light-sensitive material of the present invention preferably contains a mercapto compound described in U.S. Pat. Nos. 4,740,454 and 4,788,132, JP-A-62-18539, and JP-A-1-283551.

The light-sensitive material of the present invention preferably contains compounds which release, regardless of a developed silver amount produced by the development, a fogging agent, a development accelerator, a silver halide solvent, or precursors thereof, described in JP-A-1-106052.

The light-sensitive material of the present invention preferably contains dyes dispersed by methods described in International Disclosure WO 88/04794 and JP-A-1-502912 or dyes described in European Patent 317,308A, U.S. Patent 4,420,555, and JP-A-1-259358.

Various color couplers can be used in the present invention, and specific examples of these couplers are described in patents described in the above-mentioned RD No. 17643, VII-C to VII-G and RD No. 307105, VII-C to VII-G.

Preferable examples of yellow couplers are described in, e.g., U.S. Pat. Nos. 3,933,501; 4,022,620; 4,326,024; 4,401,752 and 4,248,961, JP-B-58-10739, British Patents 1,425,020 and 1,476,760, U.S. Pat. Nos. 3,973,968;

4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, JP-A-60-185951, U.S. Patents 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658.

Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. Nos. 4,774,181 or a coupler having a dye precursor group which can react with a developing agent to form a dye as a split-off group described in U.S. Pat. No. 4,777,120 may be preferably used.

Those compounds which release a photographically useful residue upon coupling may also be preferably used in the present invention. DIR couplers, i.e., couplers releasing a development inhibitor, are preferably those described in the patents cited in the above-described RD No. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler which imagewise releases a nucleating agent or a development accelerator are preferably those described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a ligand releasing coupler described in, e.g., U.S. Pat. Nos. 4,553,477; a coupler releasing a leuco dye described in JP-A-63-75747; and a coupler releasing a fluorescent dye described in U.S. Pat. No. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027. Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glycerol-tributyrate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Typical examples of the antiseptics and the fungicides are phenethyl alcohol, and 1,2-benzisothiazolin-3-one, n-butyl p-hydroxybenzoate, phenol, 4-chloro-3,5-dimethylphenol, 2-phenoxyethanol, and 2-(4-thiazolyl)benzimidazole, which are described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, a color paper, a color positive film, a color reversal paper, and a color intermediate film for a movie.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{\frac{1}{2}}$ is preferably 30 seconds or less, and more preferably, 20 seconds or less. The film thickness means a film thickness measured under moisture conditioning at a temperature of 25° C. and a relative humidity of 55% (two days). The film swell speed $T_{\frac{1}{2}}$ can be measured in accordance with a known method in the art. For example, the film swell speed $T_{\frac{1}{2}}$ can be measured by using a swello-meter described by A. Green et al. in Photographic Science & Engineering, Vol. 19, No. 2, pp. 124 to 129. When 90% of a maximum swell film thickness reached by performing a treatment by using a color developer at 30° C. for 3 minutes and 15 seconds is defined as a saturated film thickness, $T_{\frac{1}{2}}$ is defined as a time required for reaching ½ of the saturated film thickness.

The film swell speed $T_{\frac{1}{2}}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation:

(maximum swell film thickness—film thickness)/film thickness.

In the light-sensitive material of the present invention, a hydrophilic colloid layer (called back layer) having a total dried film thickness of 2 to 20 μm is preferably formed on the side opposite to the side having emulsion layers. The back layer preferably contains, e.g., the light absorbent, the filter dye, the ultraviolet absorbent, the antistatic agent, the film hardener, the binder, the plasticizer, the lubricant, the coating aid, and the surfactant, described above. The swell ratio of the back layer is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine color developing agent. As the color developing agent, although an aminophenol compound is effective, a p-phenylenediamine compound is preferably used. Typical examples of the p-phenylenediamine compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfates, hydrochlorides and p-toluenesulfonates thereof. Of these compounds, sulfate of 3-methyl-4-amino-N-ethyl-N-β-hydroxyethylaniline is preferred in particular.

In general, the color developer contains a pH buffering agent such as a carbonate, a borate or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as an aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-l,l-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, a well-known black-and-white developing agent, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof.

The pH of the color and black-and-white developers is generally 9 to 12. Although the quantity of replenisher of the developers depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. When the quantity of the replenisher is decreased, a contact area of a processing tank with air is preferably decreased to prevent evaporation and oxidation of the solution upon contact with air.

The contact area of the processing solution with air in a processing tank can be represented by an aperture defined below:

Aperture=(contact area ($cm^2$) of processing solution with air)/(volume ($cm^3$) of the solution)

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method described in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are compounds of a polyvalent metal, e.g., iron (III); peracids; quinones; and nitro compounds. Typical examples of the bleaching agent are an organic complex salt of iron (III), e.g., a complex salt with an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt with citric acid, tartaric acid, or malic acid. Of these compounds, an iron (III) complex salt of an aminopolycarboxylic acid such as an iron (III) complex salt of ethylenediaminetetraacetic acid or 1,3-diaminopropanetetraacetic acid is preferred because it can increase a processing speed and prevent an environmental contamination. The iron (III) complex salt of an aminopolycarboxylic acid is useful in both the bleaching and bleach-fixing solutions. The pH of the bleaching or bleach-fixing solution using the iron (III) complex salt of an aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Examples of a useful bleaching accelerator are: compounds having a mercapto group or a disulfide group described in, for example, U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD No. 17129 (July, 1978); thiazolidine derivatives described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds described in West German Patents 966,410 and 2,748,430; polyamine compounds described in JP-B-45-8836; compounds described in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, west German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxy acetic acid.

Examples of the fixing agent used in the fixing solution or the bleach-fixing solution are a thiosulfate salt, a thiocyanate salt, a thioether-based compound, a thiourea and a large amount of an iodide. Of these compounds, a thiosulfate, especially, ammonium thiosulfate, can be used in the widest range of applications. In addition, a combination of a thiosulfate with a thiocyanate, a thioether-based compound or thiourea is preferably used. As a preservative of the fixing solution or the bleach-fixing solution, a sulfite, a bisulfite, a carbonyl bisulfite adduct, or a sulfinic acid compound described in. European Patent 294,769A is preferred. Further, in order to stabilize the fixing solution or the bleach-fixing solution, various types of aminopolycarboxylic acids or organic phosphonic acids are preferably added to the solution.

In the present invention, 0.1 to 10 moles, per liter, of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955). In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and a cyabendazole described in JP-A-57-8542, a chlorine-based germicide such as chlorinated sodium isocyanurate, and germicides such as benzotriazole, described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bobai Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of water-washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are an aldehyde such as formalin or glutaraldehyde, an N-methylol compound, hexamethylenetetramine, and an adduct of aldehyde sulfite. Various chelating agents and fungicides can be added to the stabilizing bath.

An overflow solution produced upon washing and/or replenishment of the stabilizing solution can be resued in another step such as a desilvering step.

In the processing using an automatic developing machine or the like, if each processing solution described above is concentrated by evaporation, water is preferably added to correct the concentration.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and RD Nos. 14850 and 15159, an aldol compound described in RD No. 13924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

Further, the silver halide light-sensitive material of the present invention can be applied also to a heat-developing light-sensitive material as disclosed in, e.g., U.S. Pat. No. 4,500,626, JP-A-60-133449, JP-A-59-218443, JP-A-61-238056, and European Patent 210,660A2.

The silver halide color light-sensitive material of the present invention exerts its advantages more effectively when applied to a film unit equipped with a lens disclosed in JP-B-2-32615 or Examined Published Japanese Utility Model Application (JU-B) 3-39784.

EXAMPLE 1

1 kg of gelatin and 18 g of potassium bromide were dissolved in 25 l of water in a reactor vessel, and the pH and the temperature were adjusted to 5° and 75° C., respectively. 3.80 l of an aqueous solution containing 380 g of silver nitrate was added to the resultant solution over five minutes while the pAg was kept at 6.8 using 3.80 l of an aqueous solution containing 260 g of potassium bromide and 11 g of potassium iodide (1st step). Subsequently, 10.6 l of an aqueous solution containing 2,120 g of silver nitrate was added to the resultant solution over ten minutes while the pAg was kept at 6.8 using 10.6 l of an aqueous solution containing 1,440 g of potassium bromide and 63 g of potassium iodide (2nd step).

while the pAg was kept at 7.5 at 35° C., the resultant solution was washed with water twice by a coagulation precipitation method using a water-soluble polymer. 1 kg of gelatin was added and redispersion at pAg 8.0 and pH 6.5 was performed. The result was a cubic emulsion with an average grain size of 0.30 μm and an average silver iodide content of 3.0 mol %. This emulsion was labeled an emulsion A.

On the other hand, emulsions B, C, D, and E with average grain sizes of 0.25, 0.15, 0.10, and 0.05 μm, respectively, were prepared by controlling the temperature in the reactor vessel in the method of preparing the emulsion A.

A sensitizing dye I represented by the following formula was added in an amount of $3.0\times10^{-4}$ mol per mol of a silver halide to each of the emulsions A to E at a temperature of 60° C. Sensitizing Dye I

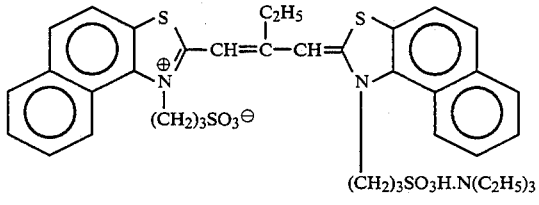

Subsequently, optimal amounts of chloroauric acid, sodium thiosulfate, and the compound Se-40, which is one practical example of the selenium sensitizers shown earlier, were added to each resultant emulsion, thereby performing chemical ripening at 60° C. for 70 minutes.

The resultant emulsions were labeled emulsions A-1, B-1, C-1, D-1, and E-1.

In addition, five types of emulsions A-2, B-2, C-2, D-2, and E-2 were prepared following the same procedures as for the emulsions A-1, B-1, C-1, D-1, and E-1, respectively, except that the temperature at the addition of the sensitizing dye was changed from 60° C. to 40 ° C.

Furthermore, two types of emulsions D-3 and D-4 were prepared following the same procedures as for the emulsion D-1 except that the addition temperature of the sensitizing dye was set at 30° C. and 22° C., respectively. Each of the emulsions A-1, B-1, C-1, D-1, E-1, A-2, B-2, C-2, D-2, E-2, D-3, and D-4 was divided into two portions, and each half portion was coated on a cellulose triacetate support under the following conditions, thereby making samples 101 to 112.

Emulsion coating conditions

| | |
|---|---|
| <Emulsion layer> | |
| Emulsion . . . emulsions subjected to chemical sensitization given in Table 1 | 0.5 g/m$^2$ |
| Coupler represented by the following formula | 1.0 g/m$^2$ |

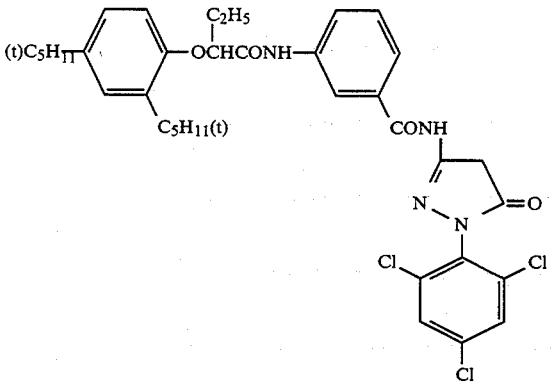

| | |
|---|---|
| Tricresylphosphate | 0.8 g/m$^2$ |
| Gelatin | 2.5 g/m$^2$ |
| <Protective layer> | |
| Gelatin | 0.30 g/m$^2$ |
| Film hardener represented by the following formula | 0.3 g/m$^2$ |

$CH_2{=}CH{-}SO_2{-}CH_2{-}CONH{-}CH_2$
$\quad\quad\quad

-continued

| | |
|---|---|
| Kodak stabilizer additive | 0.14 ml |
| Formalin (37.5% solution) | 0.50 ml |

The density of each of the processed samples 101 to 124 was measured using a green filter, and the sensitivity of each sample was obtained from the measurement result. The sensitivity was defined as the reciprocal of an exposure amount by which a density of fog +0.2 was given. Table 1 below shows the value (to be referred to as a "solution aging stability" hereinafter) calculated by dividing the sensitivity of each sample using emulsion sample aged at 40° C. by the sensitivity of the sample using the same emulsion sample not aged. A value closer to 1 represents a higher manufacturing stability.

The results shown in Table 1 reveal that the change in sensitivity of grains with a grain size of 0.2 μm or less increased when the grains were aged in the form of a solution at 40° C., but this sensitivity change was decreased when the addition temperature of the spectral sensitizing dye was set within the range of the present invention. That is, the present invention greatly improved the degradation of stability in manufacturing process caused when the grain size was decreased to 0.2 μm or smaller.

TABLE 1

| | | Results of Example 1 | | |
|---|---|---|---|---|
| Emulsion name | Average grain size | Sensatizing dye addition temperature | Solution aging stability | Remarks |
| A-1 | 0.30 μm | 60° C. | 0.98 | Comparative example |
| B-1 | 0.25 μm | " | 1.02 | Comparative example |
| C-1 | 0.15 μm | " | 0.81 | Comparative example |
| D-1 | 0.10 μm | " | 0.79 | Comparative example |
| E-1 | 0.05 μm | " | 0.76 | Comparative example |
| A-2 | 0.30 μm | 40° C. | 1.00 | Comparative example |
| B-2 | 0.25 μm | " | 1.00 | Comparative example |
| C-2 | 0.15 μm | " | 1.00 | Present Invention |
| D-2 | 0.10 μm | " | 1.00 | Present Invention |
| E-2 | 0.05 μm | " | 0.98 | Present Invention |
| D-3 | 0.10 μm | 30° C. | 0.98 | Present Invention |
| D-4 | 0.10 μm | 22° C. | 0.89 | Comparative example |

EXAMPLE 2

Emulsions F, G, H, and I with an average grain size of 0.10 μm and average silver iodide contents of 0, 2, 4, and 8 mol %, respectively, were prepared by changing the temperature in the reactor vessel and the composition of the halogen solution in the method of preparing the emulsion A of Example 1.

The sensitizing dye I used in Example 1 was added in an amount of $3.0\times10^{-4}$ mol per mol of a silver halide to the emulsions F, G, H, and I at a temperature of 60° C. Subsequently, optimal amounts of chloroauric acid, sodium thiosulfate, and the compound Se-40, which is one practical example of the selenium sensitizers shown earlier, were added to each resultant emulsion, thereby performing chemical ripening at 60° C. for 70 minutes.

The resultant emulsions were labeled F-1, G-1, H-1, and I-1.

Four types of emulsions F-2, G-2, H-2, and I-2 were prepared following the same procedures as for the emulsions F-1, G-1, H-1, and I-1, respectively, except that the temperature at the addition of the sensitizing dye was changed from 60° C. to 40° C.

Each of the emulsions D-1 and D-2 prepared in Example 1 and the emulsions F-1, G-1, H-1, I-1, F-2, G-2, H-2, and I-2 of this example was divided into two portions. Following the same procedures as in Example 1, samples 201 to 210 were formed by coating these emulsions immediately after the preparation, and samples 211 to 220 were formed by coating the emulsions after each emulsion was aged in the form of a solution at 40° C. for six hours.

Following the same procedures as in Example 1, the samples 201 to 220 were exposed and developed.

The solution aging stability defined as in Example 1 was obtained for each emulsion. The results are given in Table 2 below.

As is apparent from the results shown in Table 2, the changes in sensitivity when the emulsions were dissolved at 40° C. could be further decreased by setting the addition temperature of the spectral sensitizing dye within the range of the present invention, and by setting the silver iodide content of the halogen composition at 1 to 6 mol %.

TABLE 2

| | | Result of Example 2 | | | |
|---|---|---|---|---|---|
| Emulsion Name | Average grain size | Sensitizing dye addition temperature | Average silver iodide content | Solution aging stability | Remarks |
| D-1 | 0.10 mm | 60° C. | 3 mol % | 0.79 | Comparative example |
| F-1 | " | " | 0 mol % | 1.12 | Comparative example |
| G-1 | " | " | 2 mol % | 0.79 | Comparative example |
| H-1 | " | " | 4 mol % | 0.78 | Comparative example |
| I-1 | " | " | 8 mol % | 0.74 | Comparative example |
| D-2 | " | 40° C. | 3 mol % | 1.00 | Present invention |
| F-2 | " | " | 0 mol % | 1.05 | Present invention |
| G-2 | " | " | 2 mol % | 1.00 | Present invention |
| H-2 | " | " | 4 mol % | 0.98 | Present invention |
| I-2 | " | " | 8 mol % | 0.95 | Present invention |

EXAMPLE 3

Using the emulsions prepared in Example 1, layers having the compositions presented below were formed on triacetyl cellulose supports to make multilayered color light-sensitive materials 301 to 310.

The coating amount of each of a silver halide and colloidal silver is represented by a silver amount in units of g/m$^2$. The coating amount of each of a coupler, an additive, and gelatin is represented by an amount in units of g/m$^2$. The coating amount of a sensitizing dye is represented by the number of mols per mol of a silver halide in the same layer.

The emulsions except the one in the 5th layer were cubic emulsions subjected to normal gold/sulfur sensitization.

| | |
|---|---|
| 1st layer: Antihalation layer | |
| Black colloidal silver | silver 0.20 |
| Gelatin | 2.30 |
| 2nd layer: Interlayer | |
| Cpd-1 | 0.10 |
| Gelatin | 0.80 |
| 3rd layer: 1st red-sensitive emulsion layer | |
| Silver iodobromide cubic emulsion having an average grain size of 0.06 μm and containing 3.5 mol % of silver iodide | silver 0.19 |
| ExS-4 | proper amount |
| ExC-1 | 0.29 |
| ExC-2 | 0.19 |
| ExC-3 | 0.05 |
| Solv-1 | 0.10 |
| Solv-2 | 0.10 |
| Gelatin | 2.40 |
| 4th layer: 2nd red-sensitive emulsion layer | |
| Silver iodobromide cubic emulsion having an average grain size of 0.09 μm and containing 3.5 mol % of silver iodide | silver 0.10 |
| ExS-4 | proper amount |
| ExC-1 | 0.12 |
| ExC-2 | 0.04 |
| Solv-1 | 0.05 |
| Solv-2 | 0.05 |
| Gelatin | 0.85 |
| 5th layer: 3rd red-sensitive emulsion layer | |
| Emulsion prepared in Example 1 | silver 0.30 |
| ExC-1 | 0.085 |
| ExC-2 | 0.055 |
| Solv-1 | 0.03 |
| Solv-2 | 0.03 |
| Gelatin | 1.10 |
| 6th layer: Interlayer | |
| Cpd-1 | 0.13 |
| Gelatin | 0.65 |
| 7th: 1st green-sensitive emulsion layer | |
| Silver iodobromide cubic emulsion having an average grain size of 0.06 μm and containing 0.5 mol % of silver iodide | silver 0.42 |
| ExS-2 | $1.26 \times 10^{-3}$ |
| ExS-3 | $1.40 \times 10^{-4}$ |
| ExM-1 | 0.25 |
| ExM-2 | 0.10 |
| ExM-3 | 0.05 |
| Solv-1 | 0.42 |
| Gelatin | 2.60 |
| 8th layer: 2nd green-sensitive emulsion layer | |
| Silver iodobromide cubic emulsion having an average grain size of 0.11 μm and containing 0.5 mol % of silver iodide | silver 0.12 |
| ExS-2 | $8.0 \times 10^{-4}$ |
| ExS-3 | $9.0 \times 10^{-5}$ |
| ExM-1 | 0.07 |
| ExM-2 | 0.03 |
| ExM-3 | 0.015 |
| ExM-4 | 0.008 |
| Solv-1 | 0.15 |

-continued

| | |
|---|---|
| Gelatin | 0.60 |
| 9th layer: 3rd green-sensitive emulsion layer | |
| Silver iodobromide cubic emulsion layer having an average grain size of 0.16 μm and containing 0.5 mol % of silver iodide | silver 0.42 |
| ExS-2 | $7.8 \times 10^{-4}$ |
| ExS-3 | $8.8 \times 10^{-5}$ |
| ExM-1 | 0.08 |
| ExM-2 | 0.03 |
| ExM-3 | 0.02 |
| ExM-4 | 0.01 |
| Solv-1 | 0.14 |
| Gelatin | 1.90 |
| 10th layer: Yellow filter layer | |
| Yellow colloidal silver | silver 0.15 |
| Cpd-1 | 0.10 |
| Cpd-2 | 0.05 |
| Gelatin | 1.0 |
| 11th layer: 1st blue-sensitive emulsion layer | |
| Silver iodobromide cubic emulsion having an average grain size of 0.06 μm and containing 0.5 mol % of silver iodide | silver 0.20 |
| ExS-1 | $2.5 \times 10^{-3}$ |
| ExC-1 | 0.03 |
| ExY-1 | 0.70 |
| Solv-1 | 0.25 |
| Gelatin | 1.10 |
| 12th layer: 2nd blue-sensitive emulsion layer | |
| Silver iodobromide cubic emulsion having an average grain size of 0.12 μm and containing 2.0 mol % of silver iodide | silver 0.22 |
| ExS-1 | $2.0 \times 10^{-3}$ |
| ExC-1 | 0.01 |
| ExY-1 | 0.26 |
| Solv-1 | 0.09 |
| Gelatin | 0.45 |
| 13th layer: 3rd blue-sensitive emulsion layer | |
| Silver iodobromide cubic emulsion having an average grain size of 0.16 μm and containing 3.5 mol % of silver iodide | silver 0.37 |
| ExC-1 | 0.003 |
| ExY-1 | 0.07 |
| Solv-1 | 0.02 |
| Gelatin | 0.60 |
| 14th layer: 1st protective layer | |
| UV-1 | 0.05 |
| UV-2 | 0.24 |
| Solv-2 | 0.12 |
| Gelatin | 0.50 |
| 15th layer: 2nd protective layer | |
| B-1 (diameter 1.70 μm) | 0.01 |
| B-2 (diameter 1.70 μm) | 0.01 |
| B-3 | 0.09 |
| H-1 | 0.30 |

In addition to the above components, these samples was added with 1,2-benzisothiazoline-3-one (on average of 200 ppm with respect to gelatin), n-butyl-p-hydroxybenzoate (on average of about 1,000 ppm with respect to gelatin), and 2-phenoxyethanol (on average of about 10,000 ppm with respect to gelatin).

The samples were further added with B-4, B-5, W-1, W-2, F-1 to F-8, and F-9 to F-12.

The formulas of the compounds used in the formation of the above samples will be presented below.

ExC-1
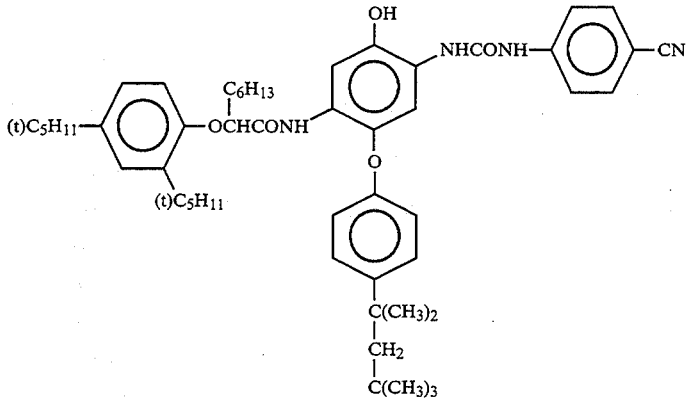
ExC-2
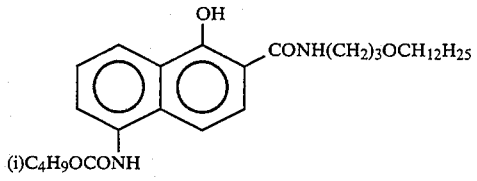
ExC-3
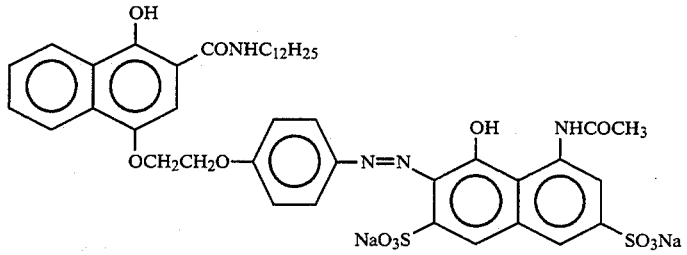
ExM-1
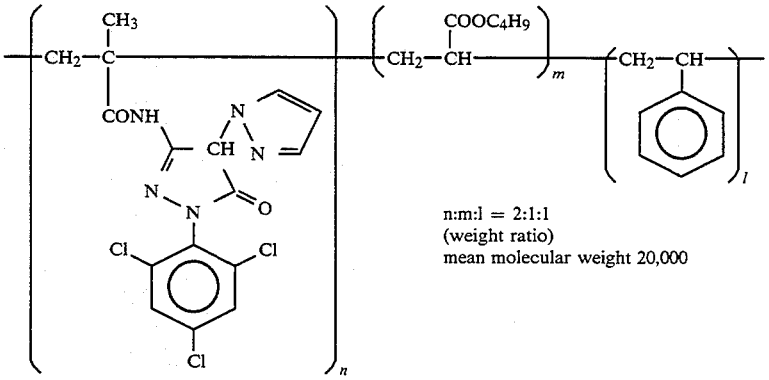
ExM-2
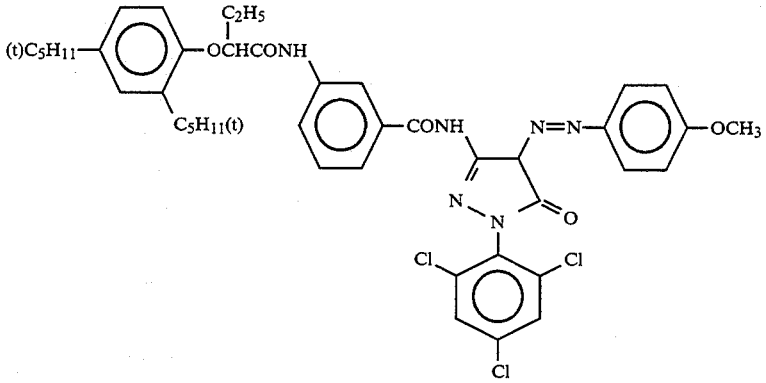

-continued
ExM-3
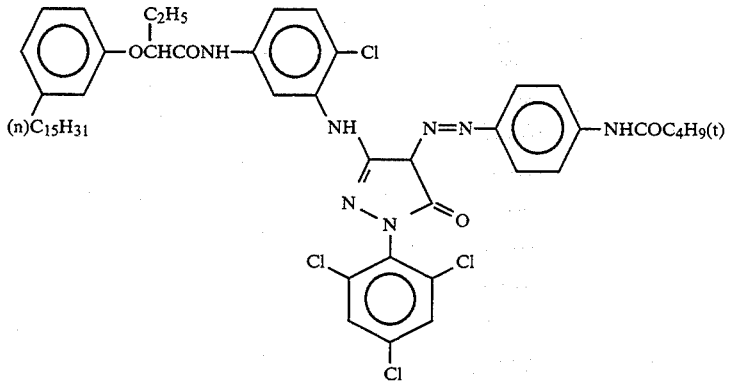
ExM-4
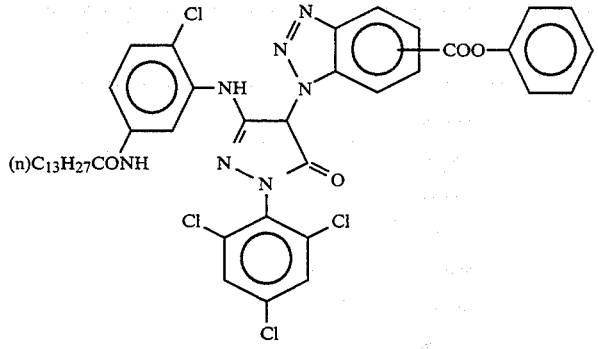
ExY-1
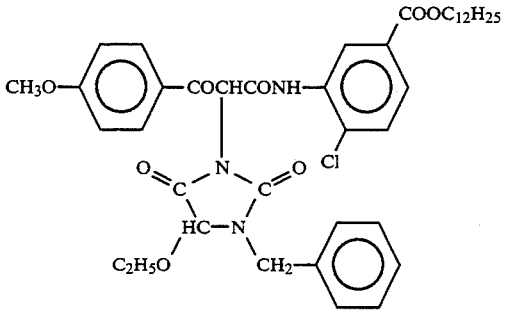
ExS-1
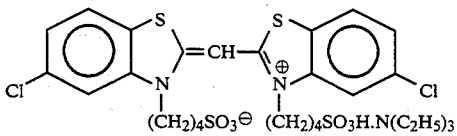
ExS-2
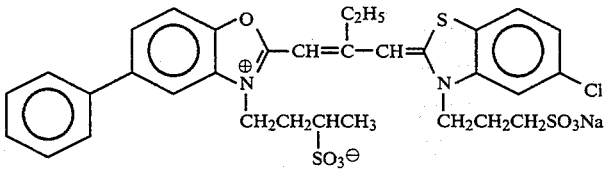
ExS-3
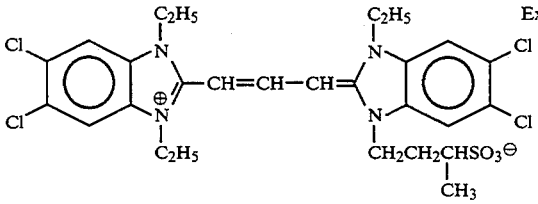
ExS-4
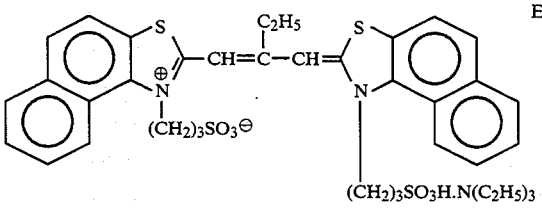
Solv-1
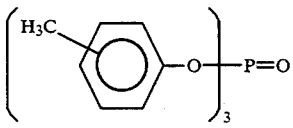
Solv-3
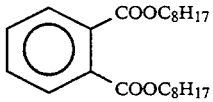

-continued
Cpd-1
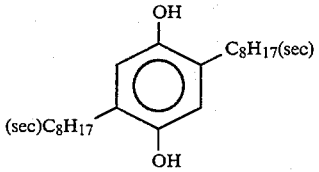
Cpd-2
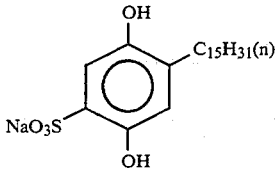
UV-1
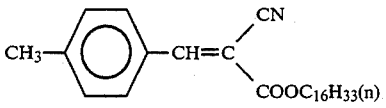
UV-2
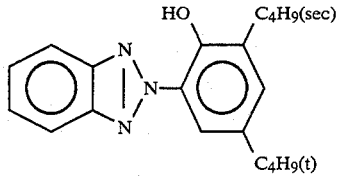
B-1
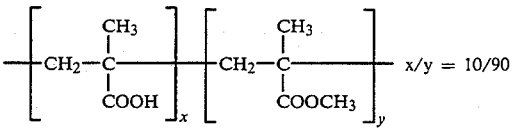
B-2
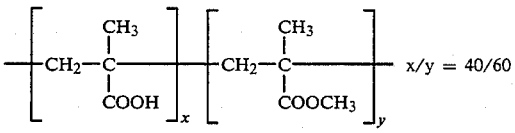
B-3
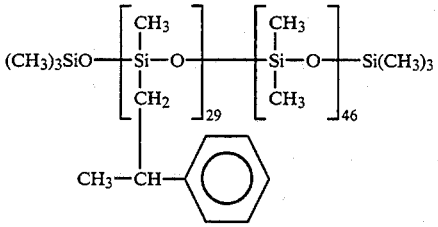
B-4
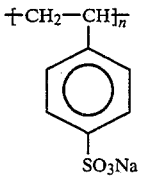
B-5
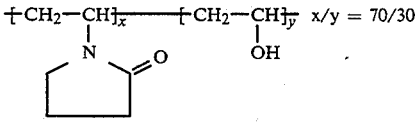
W-1
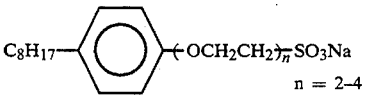
W-2
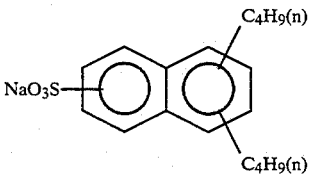
H-1
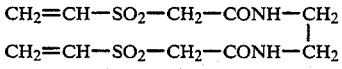
F-1
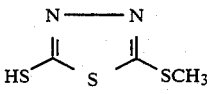
F-2
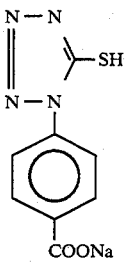
F-3
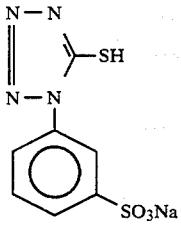
F-4
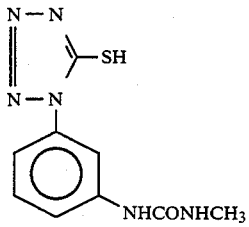

-continued

F-5

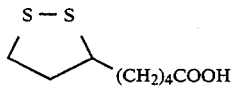

F-6

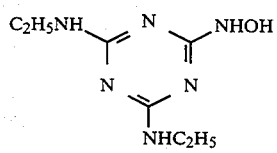

F-7

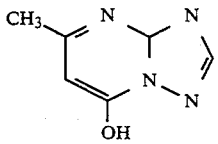

F-8

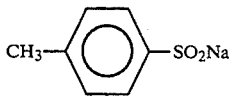

F-9

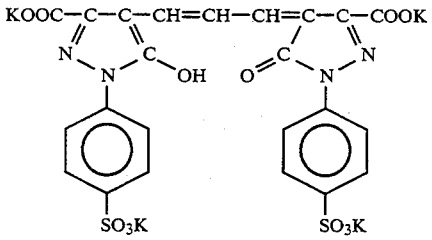

F-10

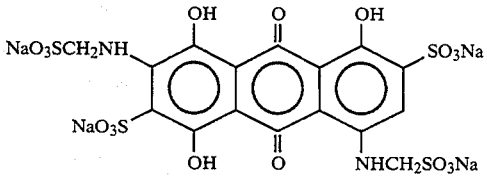

F-11

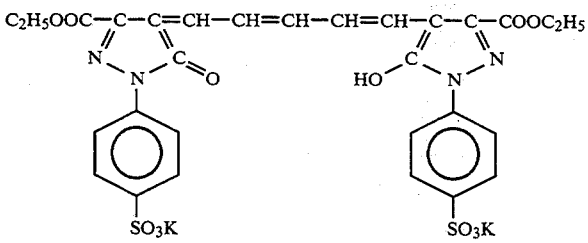

F-12

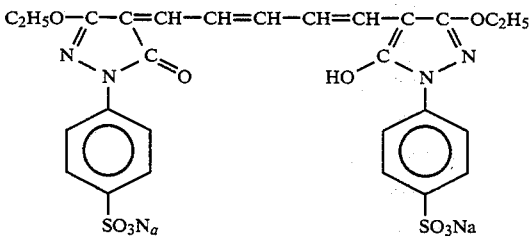

The emulsions prepared in Example 1 were used in the 5th layer as shown in Table 3 presented later.

The amounts of ExS-4 in the 3rd and 4th layers were changed appropriately in order to control the gradation in correspondence with the change in sensitivity caused by the size of the emulsion in the 5th layer.

These samples were left to stand at a temperature of 40° C. and a relative humidity of 70% for 14 hours. Thereafter, each resultant sample was exposed and developed following the same procedures as in Example 1, and the graininess and the sharpness of the sample were evaluated.

The evaluation of the graininess was performed by measuring the RMS granularity value through a red filter using an aperture 48 μm in diameter. Table 3 shows the RMS granularity value at a density of fog +1.0 as a relative value assuming that the value of the sample 301 is 100. A smaller value indicates a higher graininess.

The evaluation of the sharpness was done as follows. That is, white exposure was performed through a filter having a black sharp contrast image and a repetitive stripe pattern image (frequency =40 cycles/mm) with the same density difference as that of the image, and development was performed. The density was measured through an R filter using a micro densitometer, and a squarewave response function (to be referred to as an SRF hereinafter) defined by the following equation was calculated:

$$SRF = \frac{D_{max} - D_{min}}{\Delta D}$$

$D_{max}$: the maximum value of the micro density of the stripe pattern image $D_{min}$: the minimum value of the micro density of the stripe pattern image $\Delta D$ : the difference between the maximum density and the minimum density of the sharp contrast image Table 3 shows the value of the SRF represented by a relative value assuming that the value of the sample 301 is 100. A larger SRF value indicates a higher sharpness.

TABLE 3

| Sample No. | Name of emulsion in 5th layer | Results of Example 3: RMS granularity value | SRF value | Remarks |
|---|---|---|---|---|
| 301 | A-1 | 100 | 100 | Comparative example |
| 302 | B-1 | 75 | 106 | Comparative example |
| 303 | C-1 | 56 | 107 | Comparative example |
| 304 | D-1 | 37 | 108 | Comparative example |
| 305 | A-2 | 96 | 101 | Comparative example |
| 306 | B-2 | 70 | 107 | Comparative example |
| 307 | C-2 | 51 | 120 | Present invention |
| 308 | D-2 | 33 | 122 | Present invention |
| 309 | D-3 | 35 | 124 | Present invention |
| 310 | D-4 | 70 | 110 | Comparative example |

It is clear from the results shown in Table 3 that each light-sensitive material using the emulsions prepared by the emulsion manufacturing method of the present invention had a high graininess and sharpness. From Examples 1 and 2 and this example, it is obvious that the present invention makes it possible to manufacture an emulsion which has the property of very high graininess and sharpness, yet which is at the same time very stable in the manufacturing process.

As has been described above, according to the present invention, there is provided a method of manufacturing an emulsion which has the property of very high grainess and sharpness, yet which is at the same time very stable in the whole process of manufacturing of a silver halide light-sensitive material, specifically, very stable when the emulsion is aged in the form of a solution.

EXAMPLE 4

Emulsions J, K, L, and M comprising silver bromochloroiodide grains were prepared by changing the temperature in the reactor vessel and the composition of the halogen solution in the method of preparing the emulsion A of Example 1. The emulsions J, K, L, and M had an average grain size of 0.10 μm, an average silver iodide content of 2 molt, and average silver chloride contents of 0, 2, 4, and 6 mol %, respectively.

The emulsions J, K, L, and M were added with sensitizing dye and subjected to chemical ripening following the same procedures as for the emulsion F-2 of Example 2, thereby preparing emulsions J-2, K-2, L-2, and M-2, respectively.

Each of the emulsions J-2, K-2, L-2, and M-2 was divided into two parts. Subsequently, following the same procedures as in Example 1, samples 401 to 404 were formed by coating these emulsions immediately after the emulsions were prepared, and samples 405 to 408 were formed by coating the emulsions after the emulsions were aged in the form of solutions at 40° C. for six hours.

The samples 401 to 408 were exposed and developed in the same manner as in Example 1.

The solution aging stability defined as in Example 1 was measured for each resultant emulsion. The results are given in Table 4 below.

TABLE 4

| Emulsion name | Average grain size | Sensitizing dye addition temperature | Average silver chloride content | Solution aging stability |
|---|---|---|---|---|
| J-2 | 0–10 μm | 40° C. | 0 mol % | 1.00 |
| K-2 | " | " | 2 mol % | 0.98 |
| L-2 | " | " | 4 mol % | 0.94 |
| M-2 | " | " | 6 mol % | 0.94 |

Table 4 reveals that among other emulsions manufactured by the method of the present invention, those having a silver chloride content of 3 mol % or less could achieve a particularly excellent solution aging stability.

EXAMPLE 5

When the variation coefficients of the grain size distributions of the emulsions B, C, and D prepared in Example 1 were measured, they were found to be 0.11, 0.13, and 0.14, respectively.

The emulsions B, C, and D were mixed at a ratio of 5: 50: 5 (silver amount) to prepare an emulsion N with an average grain size of 0.15 fm and a variation coefficient of grain size distribution of 0.18.

The emulsion N was added with sensitizing dye and subjected to chemical ripening following the same procedures as for the emulsion C-2 prepared in Example 1, thereby preparing an emulsion N-2.

Following the same procedures as in Example 1, a sample 501 was formed by coating the emulsion N-2 immediately after the emulsion was prepared, and a sample 502 was formed by coating the emulsion N-2 after the emulsion was aged at 40° C. for six hours.

The solution aging stability of the emulsion N-2 was measured in the same manner as in Example 1 and compared with those of the emulsions C-2 and D-2 of Example 1. The results are given in Table 5 below.

TABLE 5

| Emulsion name | Average grain size | Variation coefficient of grain size distribution | Solution aging stability |
|---|---|---|---|
| C-2 | 0.15 μm | 0.13 | 1.00 |
| D-2 | 0.10 μm | 0.14 | 1.00 |
| N-2 | 0.15 μm | 0.18 | 0.93 |

As shown in Table 5, it was found that among other emulsions manufacture by the method of the present invention, those having a variation coefficient of grain size distribution of 0.15 or less were extremely stable in the manufacturing process, specifically, when the emulsions were aged in the form of solution.

EXAMPLE 6

The graininess and sharpness of the samples 103, 108, and 501 made in Example I and 5 were evaluated.

The measurements were done in the same manner as in Example 3 except that a green filter was used.

The results are shown in Table 6 below. Both the graininess and sharpness are represented by relative values assuming that the values of the sample 103 are 100.

TABLE 6

| Sample No. | Emulsion name | Average grain size | Variation coefficient of grain size distribution | RMS granularity | SRF value | Remarks |
|---|---|---|---|---|---|---|
| 103 | C-1 | 0.15 μm | 0.13 | 100 | 100 | Comparative example |
| 108 | C-2 | 0.15 μm | 0.13 | 91 | 112 | Present invention |
| 501 | N-2 | 0.15 μm | 0.18 | 96 | 105 | " |

Table 6 demonstrates that each emulsion manufactured by the method of the present invention had a high graininess and sharpness, and that it was possible to obtain a higher graininess and sharpness by setting the variation coefficient of grain size distribution at 0.15 or less.

What is claimed is:

1. A method of manufacturing a light-sensitive silver halide emulsion with an average grain size of 0.04 μm or more and 0.2 μm or less, wherein an average silver chloride content of the silver halide emulsion is 3 mol % or less, which comprises adding a sensitizing dye to said emulsion at a temperature of 25° C. or more and 50° C. or less, and subsequently performing chemical ripening at a temperature higher than the addition temperature of the sensitizing dye.

2. The method according to claim 1, wherein an average silver iodide content of the silver halide emulsion is 1 mol % or more and 6 mol % or less.

3. The method according to claim 2, wherein the average grain size of the silver halide emulsion is 0.13 μm or less.

4. The method according to claim 2, wherein a variation coefficient of a grain size distribution of the silver halide emulsion is 0.15 or less.

5. The method according to claim 1, wherein the average grain size of the silver halide emulsion is 0.13 μm or less.

6. The method according to claim 1, wherein a variation coefficient of a grain size distribution of the silver halide emulsion is 0.15 or less.

7. The method according to claim 1, wherein the average grain size of the silver halide emulsion is 0.13 μm to 0.04 μm.

8. The method according to claim 1, wherein the sensitizing dye is added at a temperature of 35° C. to 45° C.

9. The method according to claim 1, wherein after the sensitizing dye is added to the emulsion, the emulsion is maintained at the same temperature for five minutes or more as the temperature when the sensitizing dye was added.

10. The method according to claim 1, wherein the amount of sensitizing dye which is added is $1\times10^{-5}$ mol to $1\times10^{-2}$ mol per mol of silver halide.

11. The method according to claim 1, wherein the sensitizing dye is selected from the group consisting of a cyanine dye, a merocyanine dye, a composite cyanine dye, a composite merocyanine dye, a holopolar cyanine dye, a hemicyanine dye, a styryl dye, a hemioxonole dye and combinations thereof.

12. The method according to claim 1, wherein the chemical ripening temperature is higher by 1° C. or more than the temperature of adding the sensitizing dye.

13. The method according to claim 12, wherein the chemical ripening temperature is higher by 10° C. or more.

14. The method according to claim 1, wherein chemical ripening is performed in the presence of a chemical sensitizer selected from the group consisting of sulfur, selenium, noble metal and combinations thereof.

15. The method according to claim 14, wherein the amount of sulfur sensitizer added is $1\times10^{-7}$ mol to $5\times10^{-4}$ mol per mol of silver chloride.

16. The method according to claim 14, wherein the amount of selenium sensitizer added is $1\times10^{-7}$ to $1\times10^{-4}$ mol per mol of silver halide.

17. A method of manufacturing a light-sensitive silver halide emulsion having silver halide grains with an average grain size of 0.04 μm or more and 0.15 μm or less, wherein an average silver chloride content of the grains in the silver halide emulsion is 3 mol % or less, which comprises adding a sensitizing dye to said emulsion at a temperature of 25° C. or more and 50° C. or less, and subsequently performing chemical ripening at a temperature higher than the addition temperature of the sensitizing dye.

* * * * *